US007250221B2

(12) United States Patent
Ballyns et al.

(10) Patent No.: US 7,250,221 B2
(45) Date of Patent: Jul. 31, 2007

(54) METHOD OF PRODUCING CLAD METAL PRODUCTS

(75) Inventors: Jeff Ballyns, Oswego, NY (US); Don Doutre, Kingston (CA); Kevin Gatenby, Kingston (CA); Eric Lees, Harrowsmith (CA); Edward S. Luce, Kingston (CA); Peter Wales, Kingston (CA); Gijsbertus Langelaan, Kingston (CA)

(73) Assignee: Novelis Inc., Toronto, Ontario (CA)

( * ) Notice: Subject to any disclaimer, the term of this patent is extended or adjusted under 35 U.S.C. 154(b) by 0 days.

(21) Appl. No.: 11/361,881

(22) Filed: Feb. 24, 2006

(65) Prior Publication Data

US 2006/0177683 A1 Aug. 10, 2006

(51) Int. Cl.

| | |
|---|---|
| ***B32B 3/06*** | (2006.01) |
| ***B32B 15/01*** | (2006.01) |
| ***B22D 19/04*** | (2006.01) |
| ***B22D 19/16*** | (2006.01) |

(52) U.S. Cl. ..... 428/609; 428/614; 164/111

(58) Field of Classification Search ..... None
See application file for complete search history.

(56) References Cited

U.S. PATENT DOCUMENTS

| | | | | | |
|---|---|---|---|---|---|
| 59,189 | A | * | 10/1866 | Cornell | 164/109 |
| 69,157 | A | * | 9/1867 | Baldwin | 164/111 |
| 351,297 | A | * | 10/1886 | Tobin | 114/12 |
| 359,319 | A | * | 3/1887 | Godfrey | 164/110 |
| 397,617 | A | * | 2/1889 | Tilden | 428/609 |
| 428,240 | A | * | 5/1890 | Yale | 428/593 |
| 543,192 | A | | 7/1895 | Rodig | |
| 787,092 | A | * | 4/1905 | Gallagher | 188/250 B |
| 987,774 | A | * | 3/1911 | Torsell | 428/609 |
| 1,111,807 | A | * | 9/1914 | Self | 164/95 |
| 1,186,172 | A | * | 6/1916 | Conlin | 164/111 |
| 1,610,945 | A | * | 12/1926 | Goldsmith et al. | 428/609 |
| 1,692,550 | A | * | 11/1928 | Goldsmith et al. | 164/108 |
| 1,927,306 | A | * | 9/1933 | Campbell | 188/218 R |
| 2,317,794 | A | * | 4/1943 | Neubert | 428/594 |
| 2,809,079 | A | * | 10/1957 | Daub | 277/456 |
| 3,309,123 | A | * | 3/1967 | Edwards | 264/80 |
| 3,372,007 | A | * | 3/1968 | Shaver | 428/594 |
| 4,508,969 | A | * | 4/1985 | Janberg et al. | 250/506.1 |
| 4,818,728 | A | * | 4/1989 | Rai et al. | 438/108 |
| 6,251,527 | B1 | | 6/2001 | Schelin et al. | 428/582 |
| 6,328,092 | B1 | * | 12/2001 | Guetlbauer et al. | 164/98 |
| 6,818,078 | B2 | | 11/2004 | Kim et al. | 148/522 |

FOREIGN PATENT DOCUMENTS

| | | | |
|---|---|---|---|
| GB | 2024346 | * | 1/1980 |

* cited by examiner

*Primary Examiner*—John J. Zimmerman
(74) *Attorney, Agent, or Firm*—Cooper & Dunham LLP

(57) ABSTRACT

A method of producing a clad metal ingot suitable for rolling to form a clad metal sheet, and the clad metal ingot so produced. The method involves providing a solid core ingot having an upper side with a rolling face thereon having cavities extending inwardly into the ingot from the rolling face. All or all-but-one of the cavities are blocked against molten metal entry and casting cores extending outwardly from the rolling surface are provided in alignment with the cavities. Molten cladding metal is cast on the rolling face around the casting cores to produce a composite ingot and the casting cores are removed to produce voids in the cladding layer, and the cavities are unblocked. The resulting interconnected cavities and voids are filled with a molten metal to form cast-in-place metal lugs keying or pinning the cladding layer to the core ingot.

23 Claims, 4 Drawing Sheets

METHOD OF PRODUCING CLAD METAL PRODUCTS

BACKGROUND OF THE INVENTION (1) Field of the Invention

This invention relates to the cladding of metal ingots used for the formation of metal sheet by rolling. More particularly, the invention relates to cladding such ingots on one or both faces thereof.

(2) Description of the Related Art

It is well known to produce sheets of metal (particularly, although not exclusively, aluminum and aluminum alloys) provided with a core layer of one metal (e.g. AA3003 containing aluminum and 1% by weight Mn) and a thin cladding layer of a different metal (e.g. a high silicon-content alloy, such as Al plus 7 to 10% by weight Si) on one or both major surfaces. Such composite metal sheet is used, for example, as brazing sheet in which a core of a relatively high melting point aluminum alloy is clad with a thin layer of a low melting point alloy to permit attachment of metal components by brazing. In other cases, an alloy that is easily corroded may be clad with a corrosion-resistant alloy to prevent premature degradation.

Typically, clad metal sheet of this kind is produced by co-rolling of a core ingot and one or more plates of the cladding metal. Several hot-rolling and cold-rolling steps are normally undertaken to achieve the gauge reduction required and, during this process, the different metal layers become welded together by the heat and pressure of rolling. There is always a risk, however, that the plates or sheet layers will separate during the rolling process with potentially dangerous and damaging results. The likelihood of this is greatest at the start of rolling and, to prevent this, the cladding plate (or plates) may be secured to the core ingot by means of steel bands during a preheating step, in order to achieve a degree of bonding, followed by removal of the bands prior to rolling. This is a very demanding operation for the operators of the process given that the ingots may have a temperature in the region of 400° C. or more when the bands have to be removed.

Alternatively, the ingot and plate(s) may be welded together at their edges prior to rolling, but welding is time-consuming and is difficult or impossible at times due to warping of the plates.

U.S. Pat. No. 543,192, which issued to A. Rodig on Jul. 23, 1895 discloses a cladding process in which the cladding plates are physically interlocked to the core ingot by means of inter-engaging undercut or overhanging portions. The ingot is provided with furrows, grooves, recesses or overhanging projections and the cladding plate is formed with correspondingly shaped parts or is cast on the ingot surface.

U.S. Pat. No. 6,251,527 which issued to Schelin et al. (Alcoa) on Jun. 26, 2001 grooves the core ingot to provide a liner bed for receiving the cladding plate. A continuous upstanding lip provided at the edges of the ingot holds the cladding plate against slippage during rolling.

U.S. Pat. No. 6,818,078 which issued to Kim et al. (Liquidmetal Technologies) on Nov. 16, 2004 relates to a method of joining an amorphous metal to a non-amorphous metal. This is achieved by forming a cast mechanical joint between the two materials to create mechanical interlocking.

A problem encountered with mechanical interlocking or inlaying of metals of different kinds is that, during casting or cooling, thermal contraction of the metal or metals may result in cracking if one metal is mechanically fixed to another metal.

BRIEF SUMMARY OF THE INVENTION

An exemplary aspect of the invention provides a method of producing a clad metal ingot suitable for rolling to form a clad metal sheet. The method comprises the steps of: providing a solid core ingot having an upper rolling face and at least two undercut cavities extending inwardly into the ingot from the upper rolling face at mutually spaced positions; blocking all, or all-but-one, of the cavities against molten metal entry to form one or more blocked cavities, and providing a casting core extending outwardly from the upper rolling face in alignment with each of the blocked cavities. Each casting core has a shape to produce an undercut void in a subsequently cast cladding layer. A molten metal is then cast on the upper rolling face around the casting core(s) to produce a composite ingot having a solid cladding layer cast on the upper rolling face of the core ingot, except where the upper rolling face is covered by the casting core(s). The casting cores are then removed to form one or more undercut voids in the cladding layer, and the blocked cavity(ies) are unblocked, thereby interconnecting aligned void(s) and cavity(ies). The aligned void(s) and cavity(ies) are filled with a molten metal and the metal allowed to solidify to form at least one metal lug therein attaching the cladding layer to the core ingot.

Another exemplary aspect provides a clad metal ingot suitable for rolling to form a clad metal sheet. The ingot has a core metal ingot with at least one rolling face; at least one cladding layer on the rolling face; and at least one cast-in-place metal lug keying together the core metal ingot and the at least one cladding layer, the metal lug having been cast separately from the cladding layer(s).

By the term "undercut cavity" or "undercut void" we mean that a cavity or void is shaped such that a metal lug cast therein cannot be withdrawn from the cavity or void to allow separation of a cladding layer from an ingot without deformation or shearing of the lug and/or the adjacent metal of the ingot or cladding layer. Generally, the sidewalls of the cavity or void are not perpendicular to the rolling face of the ingot and slope at an acute included angle away from the rolling face or the adjacent cast surface of the cladding layer, or the sidewalls are shaped to provide an expansion of the width of the cavity or void compared to the width of the entrance to the cavity or void at the rolling face or adjacent cast surface. A dovetail shape in cross-sectional view is preferred.

DETAILED DESCRIPTION OF THE INVENTION

The present invention employs a direct casting procedure to produce a clad ingot suitable for hot and cold rolling to form clad metal sheet. The direct casting procedure is referred to colloquially as "puddle casting" as it involves pouring a molten cladding metal onto a rolling face of a previously-formed solid core metal ingot to form a pool or "puddle", and allowing the cladding metal to solidify in place to form a cladding layer. This can be done on one or both rolling faces of the (generally rectangular) core ingot and, indeed, more than one cladding layer may be provided on each rolling face by pouring further molten metal onto a previously-cast cladding layer. Alternatively, a first cladding layer may be formed by casting and a solid second cladding layer may then be inserted between the cast layer and the core ingot as very little or no bonding occurs between the core ingot and a cast cladding layer, so layer separation is usually quite easy.

However, the ease of layer separation causes problems both in handling of the ingot and during rolling. Clearly, it is important to keep the layers together and properly aligned until a strong bond can be formed between the ingot and one or more cladding layers during the rolling procedure. To overcome the problem of layer separation during handling and rolling of the composite ingot, the core ingot and cladding layer(s) are pinned or keyed together (i.e. mechanically interconnected) by means of at least two mutually spaced-apart cast-in-place metal lugs extending through the cladding layer(s) and into the core ingot. The spacing of the lugs should desirably be sufficient to provide a secure fastening of the layers and preferably requires at least one lug at or near each longitudinal end of the ingot. In the invention, all (or all-but-one) of these metal lugs are cast after the cladding layer(s) has solidified and cooled following direct casting of the cladding layer(s) on the solid core ingot. This allows the cladding layer(s) to contract without physical constraint during solidification and cooling, thereby avoiding the generation of internal tension and possible cracking. Bearing in mind that the cladding metal can contract by about 30 mm lengthwise and about 6 mm from side to side on a standard 10 foot ingot, the ability to contract unrestrained is a significant advantage.

Figure 1A:
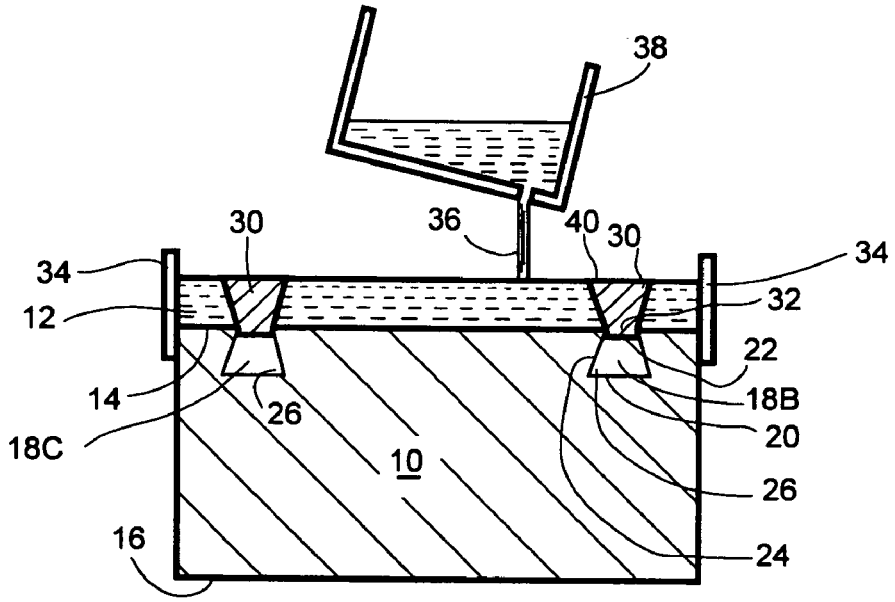
FIG. 1A is a cross-section of a core ingot having a cladding layer cast thereon, according to one form of the present invention.
Figure 1B:
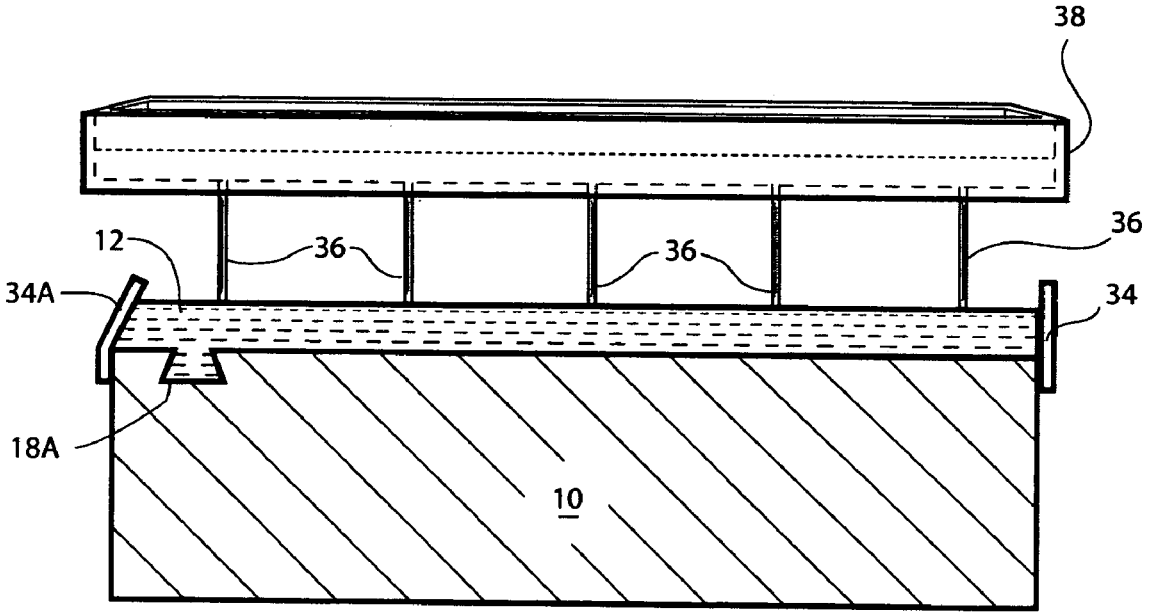
FIG. 1B is a cross-section of the core ingot and cladding layer of FIG. 1 taken at right angles to the view of FIG. 1.
Figure 2:
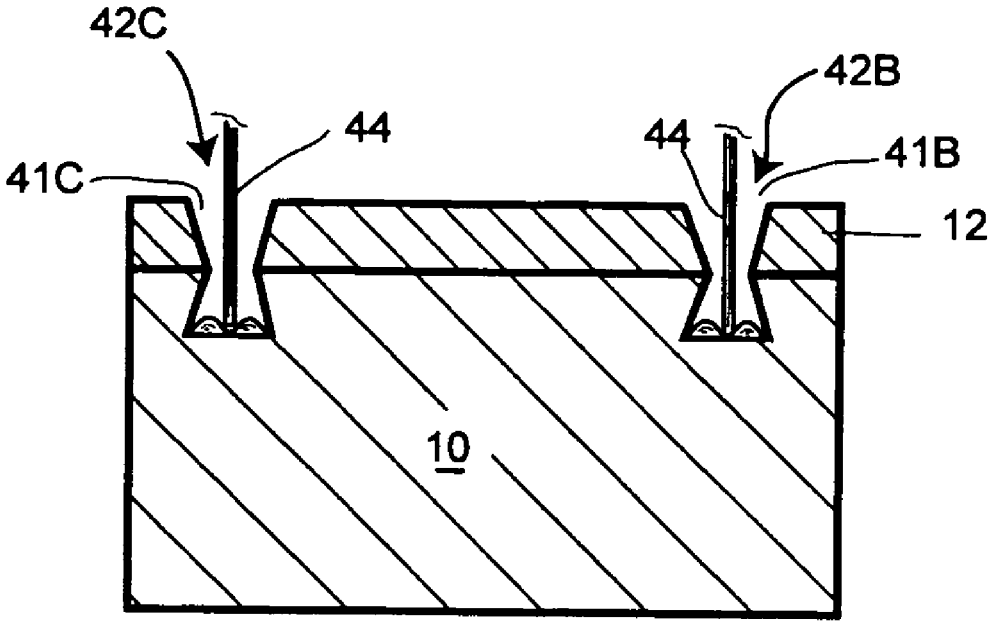
FIG. 2 is a cross-section showing the product of the method of FIG. 1, wherein filling of cavities is commencing.
Figure 3:
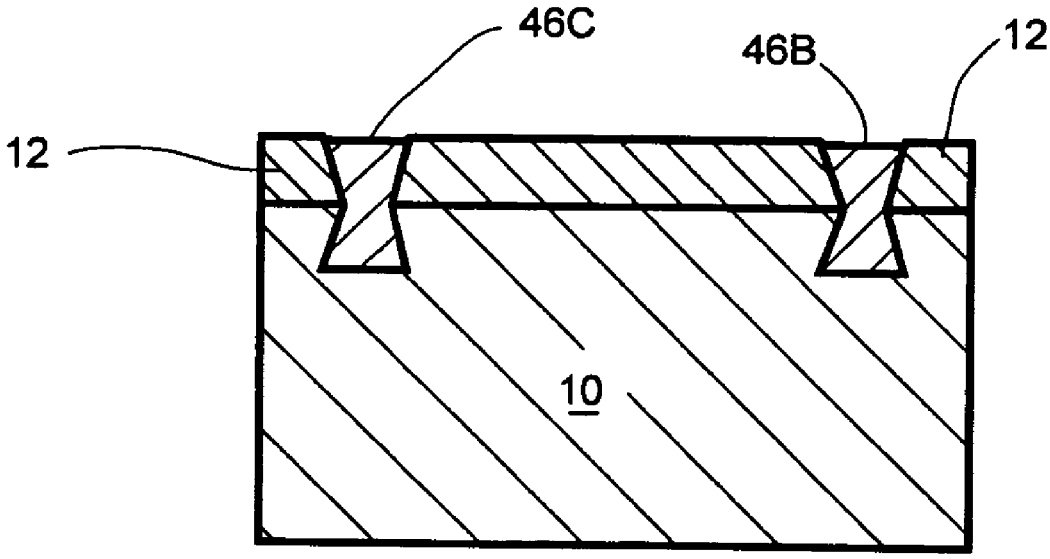
FIG. 3 is a cross-section showing a clad ingot resulting from the steps of the invention.

A preferred method of achieving this is explained in connection with FIGS. 1A, 1B, 2 and 3, which show a cross-section of a core ingot 10 and a cladding layer 12. FIGS. 1A, 2 and 3 show the ingot sectioned in a direction transverse to the intended rolling direction of the ingot, and FIG. 1B is in a longitudinal (rolling) direction. The core ingot 10 is a rectangular ingot produced by a conventional method, e.g. direct chill (DC) casting, and it is preferably an aluminum alloy suitable as a core layer of a brazing sheet (e.g. AA3003 or X900). The intended rolling faces of the ingot may be scalped prior to use in the present invention if an improvement of surface flatness is desired.

The core ingot 10 has two rolling faces, i.e. an upper rolling face 14 and a lower rolling face 16. Close to the tail of the core ingot (i.e. the part of the ingot that is rolled last in a rolling operation), the upper face 14 is provided with a pair of parallel cavities 18B and 18C in the form of elongated channels of "dovetail" cross-sectional shape (i.e. the bottom surface 20 is wider than the upper entrance 22, so that the sidewalls 24 slope outwardly, i.e. the included angle is less than 90°, as they descend into the ingot to form undercuts 26). Each cavity of the pair is positioned closely adjacent to an opposite side edge of the core ingot as shown, and may be formed by machining the ingot with a router-like tool before the direct casting operation commences. While the cavities 18B and 18C extend in the longitudinal (i.e. rolling) direction of the ingot, they preferably do not extend for the entire length of the ingot as will be explained more fully later. Moreover, the upper rolling face 14 is also provided with an elongated transverse cavity 18A adjacent to the head of the ingot (the part of the ingot that is rolled first in a rolling operation), as shown in FIG. 1B.

As shown in FIG. 1A, before the casting operation commences, the entrances 22 of the cavities 18B and 18C are covered or blocked to prevent molten metal from entering into these cavities. This is done by positioning trapezoid-shaped casting cores 30 at the entrances 22 of the cavities and extending outwardly away from the rolling face 14. In fact the lower ends 32 of the casting cores may penetrate a short distance into the depressions 18 (as shown) so that they fully block the entrances and are held securely in place. Additionally, the casting cores 30 may be additionally held in place at their upper ends by bands, metal weights or metal rods (not shown) to overcome any inherent buoyancy of the cores when surrounded by molten metal. The material used for the cores 30 may be any material that does not chill the metal quickly and survives a brief encounter with the molten cladding metal and a more prolonged exposure to high temperature. Suitable materials include non-wetting calcium silicate-based refractory board (Pyrotek B3™), bonded sand, graphite, and iron or steel coated with a material to reduce the rate of heat extraction and to avoid wetting by the molten metal.

Temporary end dams 34 are positioned around the edges of the rolling face 14 so that molten metal will not be lost during the casting procedure and will form a pool or puddle 12 of desired thickness. A molten metal suitable for the cladding layer (e.g. AA4343 containing 7.5% by weight Si) is poured quickly onto the rolling face 14 preferably in several mutually spaced streams 36 from a container 38 held above the ingot 10 and provided with a quantity of the molten metal designed to produce a cladding layer of suitable thickness. Sufficient molten metal is poured onto the rolling face to produce a layer 12 that does not overflow the molding cores 30. The pouring orifices in the container 38 are preferably positioned to the front surface shown in FIG. 1A and the container slightly tilted at the rear to ensure that all the metal drains quickly from the container. Suitable valves or bungs (not shown) are provided to prevent the flow of metal until the precise casting time desired.

The metal of the layer 12 is then left to cool and solidify, after which, the casting cores 30 are removed from cavities 18B and 18 C, e.g. by prying them out with a suitable tool or raising them by suitable equipment (not shown), to produce the intermediate product shown in FIG. 2 having voids 41B and 41C in the cladding layer communicating with the cavities 18B and 18C, respectively, in the ingot to form double-dovetail cavities 42B and 42C. The cavities 42B and 42C are then filled with molten metal in streams 44, as illustrated, to form double-dovetail lugs 46B and 46C. Of course, when forming lugs 46B and 46C, temporary end dams similar to those shown in FIG. 1 are required at the ends of the cavities to retain the metal (the end dams 34 may be left in place for this purpose, if desired). The molten metal used for the formation of the lugs may be the same metal as that used for forming the cladding, or a different metal (e.g. a metal that is possibly less brittle and has a good tensile strength). As shown in FIG. 3, after cooling and solidification, the double-dovetail lugs 46B and 46C mechanically key or tie the core ingot 10 and cladding layer 12 together, thereby preventing separation (which would require shearing or deformation of the lugs or the adjacent metal of the core ingot or cladding layer).

Figure 4A:
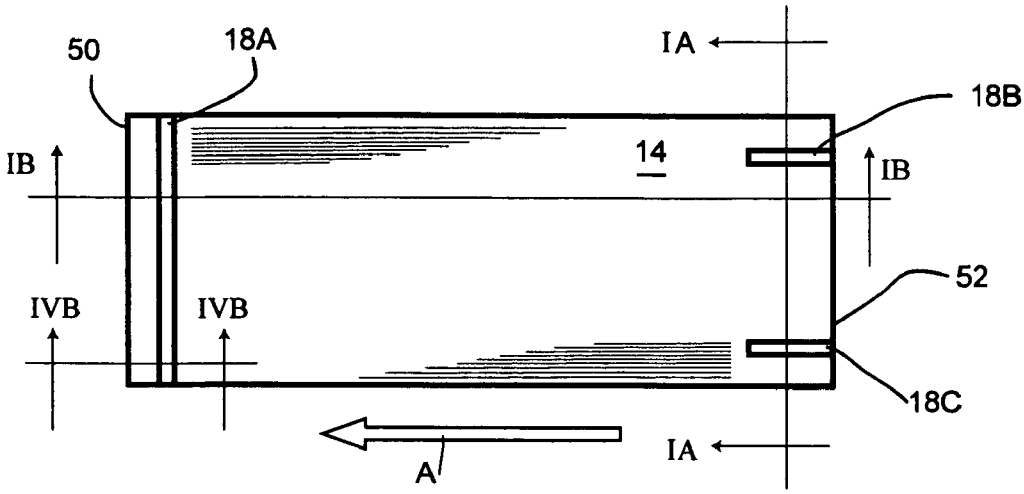
FIG. 4A is a top plan view of the core ingot of FIG. 1 (rotated through 90 degrees) showing the depressions in the rolling face.
Figure 4B:
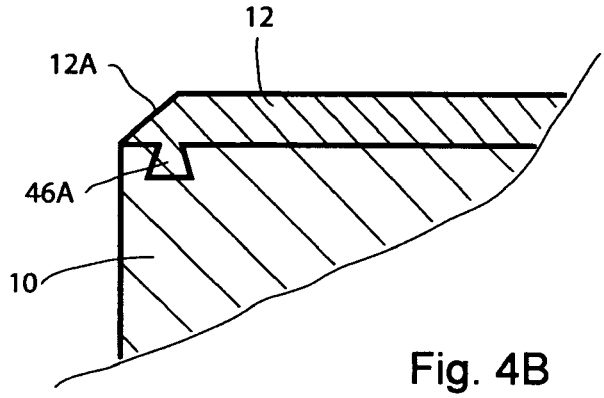
FIG. 4B is a partial cross-section of the region IVB-IVB of the ingot of FIG. 4A, but showing in addition a cladding layer 12 cast thereon.

Referring to FIGS. 1B and 4A, it has previously been mentioned that a single elongated cavity 18A is provided at the head end of the ingot so that, in the finished product, the cladding layer is keyed to the ingot both at the head and at the tail of the ingot. FIG. 4B is a partial vertical cross-section of the ingot of FIG. 4A adjacent the head end, but also showing the solid cladding layer 12 cast in place. The cladding layer 12 is subjected to the most stress at the head of the ingot where the ingot first enters the rolling apparatus and, in particular, the first pass in a hot rolling mill, so this is why the cavity 18A is made longer than the cavities 18B and 18C, and why it extends transversely of the rolling direction instead of parallel to it. Optionally, the cladding layer 12 also has a sloping leading edge 12A that helps to feed the clad ingot smoothly between the rolls of the mill on the first path. This sloping edge can be created by suitably angling the adjacent end dam (34A of FIG. 1B) prior to casting the layer. In a preferred form of the invention, this cavity 18A is not blocked prior to casting of the cladding layer 12 (as shown in FIG. 1B), so the cladding metal enters the cavity and, on solidification, forms a solid metal single-dovetail lug 46A that is continuous with the metal of the cladding layer 12. This forms a point of physical constraint between the cladding layer 12 and the ingot 10. However, because there is only one point of physical constraint present as the metal of cladding layer 12 cools and solidifies (i.e. before lugs 46B and 46C are cast), the metal of the cladding layer is free to shrink and move on the core ingot 10 as necessary, so cracking of the cladding layer is avoided. Metal lugs 46B and 46C may then be cast-in-place as indicated above and serve to tie the cladding layer to the ingot at the tail end thereof. These lugs 46A, 46B and 46C keep the cladding layer from moving around during handling and provide some resistance to sideways slip during the first pass on rolling.

The sloping walls of the double dovetail lugs 46B and 46C, as well as the single dovetail lug 46A, resist removal of the lugs and prevent separation of the layers. However, any form of "undercut" in the walls of the cavities would be effective to prevent separation of the layers. For example, the sloping walls may be on one side only of the cavity or the cavity may be of an "hour-glass" shape.

To form a double-sided clad ingot, an ingot clad in the above manner on one face 14 may be inverted and the indicated method steps repeated on the previously lower face 16 of the ingot. The lugs cast on the upper rolling face 14 keep the cladding layer on that face in place as the ingot is inverted.

The composite ingot thus formed may be rolled essentially in the same way as an ingot made solely of the core metal and it is found that the number of rolling passes required to reach a target gauge is generally similar to that required for rolling the core material itself. This is in contrast to the experience of rolling other composite ingots, for which more rolling passes causing lower amounts of deformation may be required to avoid slippage between the layers.

After rolling, the portions of the rolled sheet containing the remnants of the lugs 46A, 46B and 46C are generally removed because a clad layer of constant thickness over the entire sheet product is normally required. For this reasons, the cavities 18A, 18B and 18C may be positioned to minimize scrap production while still achieving good integration of the layers. The positions shown in FIG. 4A achieve this. This not only reduces metal loss, but minimizes the recycling difficulties of handling scrap of mixed alloys (cladding and core). Of course, other numbers and arrangements of the depressions may be preferred in some cases.

In some cases, when casting a cladding layer in this way onto a core layer (or a previously-applied cladding layer) it is desired that the molten metal poured onto the solid surface should not damage or melt that surface. Such damage or melting can normally be avoided if the temperature of the molten metal cast onto the surface is below the liquidus temperature of the core metal. However, there is a risk of damage if the melting point of the cladding metal exceeds the solidus of the metal of the core ingot. In such cases, the possibility of damage can be reduced by pouring the metal in multiple streams 36 spread out over the surface and, if necessary, by moving the streams around the surface as the casting takes place. This avoids spot overheating of the solid surface and allows the metal to be poured as quickly as possible without local overheating. Ideally, the pouring should be complete before the cladding metal starts to solidify. If the pool of metal is still liquid when the pouring is complete, the surface will be self-leveling and post-casting preparation for rolling may be reduced. Alternatively, melting damage may be avoided by initiating a pouring operation, interrupting it briefly to allow a skull of metal to solidify, and then resuming a pouring operation. Combinations of these techniques can of course be employed. Using this approach, it is possible (for example) to clad a 7000 series alloy (used as the core ingot) with a 1000 series alloy for purposes such as corrosion resistance. Generally, though, the process of the invention can produce casting layer thicknesses of any desired range provided the core ingot surface is level and suitably rapid pouring can be achieved. Even layers of 0.5 inches can be produced for a relative clad layer thickness of 2% of the ingot thickness.

The procedure explained above can be extended to cast multiple cladding layers on a single core ingot using appropriate modifications to the placement of the cores 46. For example, if multiple cladding layers are required in a rolling face of the core ingot, a second (or third, etc.) layer of metal may be cast on an underlying solid cladding layer before the casting cores 30 are removed. Of course, if this is intended, the casting cores 30 should be provided with a height corresponding to at least the combined thickness of the multiple cladding layers and the height of the dams 34 should also be made to correspond. To prevent melting or surface deformation of an underlying casting layer as an overlying one is being cast, it is preferable (although not essential in all cases) to use metals of different melting point with the higher melting metal used as the inner cladding layer.

Figure 5:
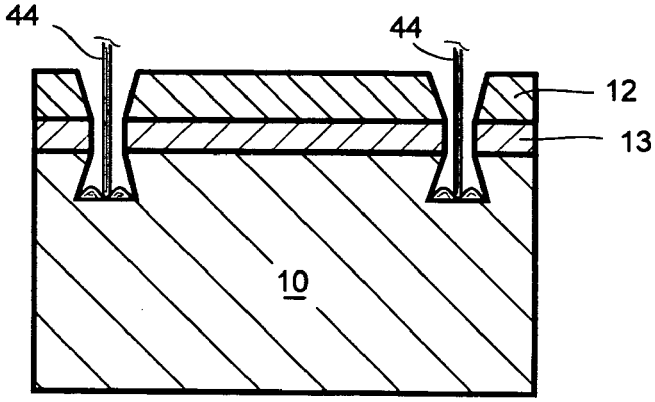
FIG. 5 is a cross-section similar to FIG. 2, but showing the introduction of a pre-formed solid cladding layer between the core ingot and the cast cladding layer.
Figure 6:
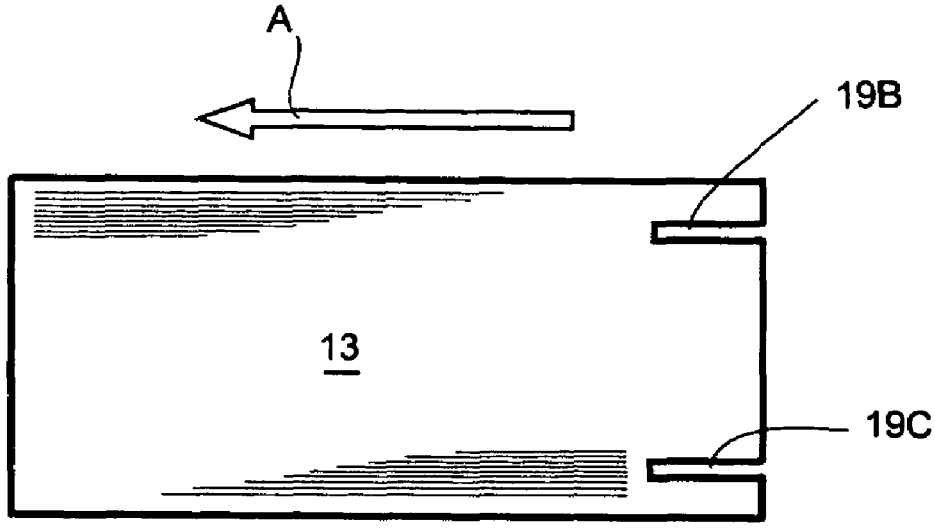
FIG. 6 is a plan view of the pre-formed solid cladding plate of FIG. 5 (rotated through 90 degrees)

As noted above, it is possible after cooling to separate a cladding layer 12 from a core ingot 10 quite easily, e.g. by lifting, because there is little bonding or metal transference at the interface of the metals. Even if the cavity 18A is not blocked during the casting of the cladding layer (so that the cladding layer becomes keyed to the ingot at the head end), it is still possible to lift the cladding layer slightly at the tail end (assuming that the cavities 18B and 18C are suitably blocked during casting). Therefore, an alternative method of forming multiple cladding layers may be employed, as shown in FIGS. 5 to 7.

In this case, a first cladding layer 12 is formed by the method of FIG. 1, with cavity 18A unblocked and cavities 18B and 18C blocked with casting cores before the layer 12 is cast. The casting cores 30 are removed after casting the layer 12 and allowing it to solidify. The cladding layer is then lifted slightly from the ingot at the tail end 52 and an additional cladding plate 13 (as shown in FIG. 6) is then slid in between the core ingot 10 and the first cladding layer 12. The layer cladding layer 12 is then pressed down on top of the plate 13 to form the structure shown in FIG. 5 at the tail end. As shown in FIG. 6, the plate 13 is a pre-formed component having holes 19B and 19C shaped and positioned to align with the cavities 18B and 18C. The plate 13 is shorter than the ingot 10, so that it terminates short of the cavity 18A because the cladding layer 12 is keyed to the ingot at this position. After re-assembly of the clad ingot, the interconnecting cavities, holes and voids are filled (as shown in FIG. 5) with molten metal 44 to form lugs (not shown) similar to lugs 46B and 46C of FIG. 3, thereby keying the layers together. If desired, additional intermediate pre-formed cladding layers may be added before re-assembly and lug formation.

Figure 7:
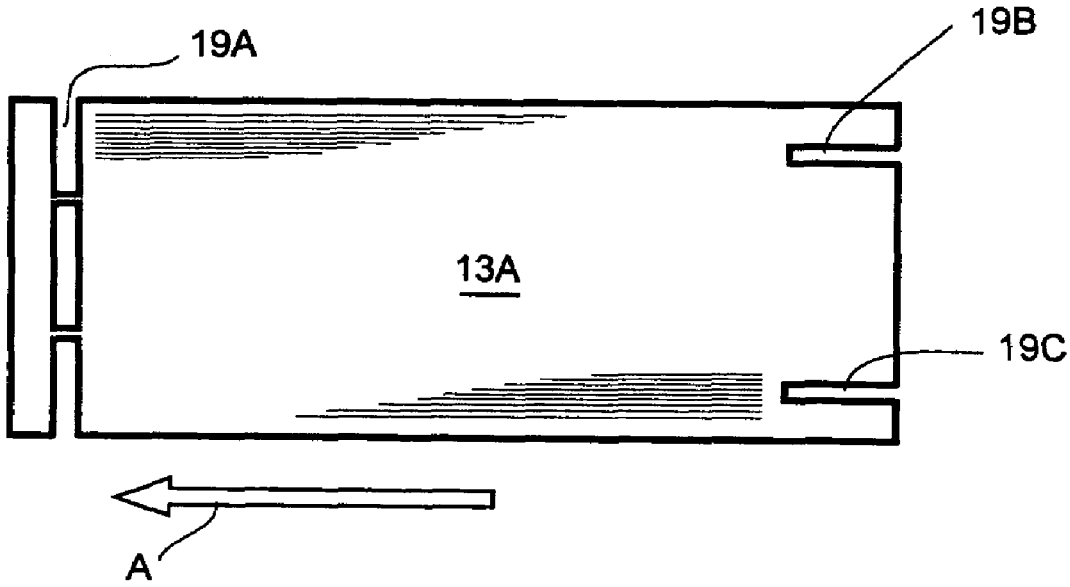
FIG. 7 is a view similar to FIG. 6 of an alternative cladding plate.

Of course, if channel 18A is also blocked before the casting of cladding layer 12, the entire cladding layer 12 may be lifted to receive a cladding plate, such as the plate 13A shown in FIG. 7. The plate 13A is the same size as the underlying ingot and is provided with a hole 19A aligned with the cavity 18A as well as holes 19B and 19C. Hole 19A is, in fact, a series of aligned slots (as shown) so that the piece at the head end of the hole 19A remains attached to the remainder of the plate. Moreover, to maintain the cladding layer 12 as a single piece, the cavity 18A would be fully blocked, but a core used to create a void in cladding layer 12 aligned with cavity 18A would not extend fully across the width of the ingot, e.g. it could be made to terminate a short distance from each lateral side edge of the ingot, allowing the cladding layer 12 to form short connecting pieces between the parts of the layer cast on opposite longitudinal sides of the channel 18A. Double-dovetail lugs would then be cast in the cavities and voids 18A, 19A and 18B, 19B and 18C, 19C.

A further alternative is to position one or more pre-formed intermediate cladding layers onto the rolling face of the core ingot and then to cast an outermost cladding layer onto the resulting assembly using the technique of FIG. 1. However, this is not preferred because pouring a molten metal onto a thin pre-formed cladding plate may cause buckling of the plate that can allow metal to penetrate below the pre-formed plate and also give rise to non-uniform thickness.

In other cases, however, a degree of local bonding between the core and cladding may be desirable. Stronger bonding can be achieved by suitably directing the metal entry points and controlling the temperature of the molten metal such that local remelting and bonding would be achieved. In such cases, it is also desirable to use a metal flux. For example, the solid surface of the core ingot may be coated with a solid flux, e.g. NOCOLOK® flux (aluminum potassium fluoride, available from Solvay Chemicals, Inc. of Houston, Tex., USA), that cleans the respective surfaces of oxides and ensures more intimate contact and transference of the metal of the surfaces. The process of the invention makes it easy to use such a flux because it can merely be coated on the surface of the core ingot.

EXAMPLE

A batch of four core ingots each of size ten feet by four feet was provided with dovetail cross-section by machining channels in the positions shown in FIG. 4A. The channels at the tail of the ingot were 12 inches in length. The two longitudinal channels were covered with molding cores of the shape shown in FIG. 1 and a cladding layer was cast on the surface of the core ingot, as shown in FIGS. 1 to 3, 4A and 4B. The cladding layer, after cooling, did not have any observable cracks. The casting cores were removed and the resulting cladding layer was lifted from the core at one end by approximately 50 mm and a pre-formed solid thin intermediate cladding layer having holes corresponding to the longitudinal cavities was slid between the core ingot and the previously-cast cladding layer. The cast cladding layer was then released and a 900 Kg weight was placed on top in order to force the clad layer back down. Lugs made of AA356 alloy were then cast into the resulting cavities to key the layers together. The resulting composite structure was rolled without separation and the residual lugs were trimmed from the extreme ends of the rolled product.

The metals used for the different members of the batch were as shown in the following Table.

TABLE

| Cladding Alloy | % Clad | Core Ingot Alloy | Sides Clad | Interlayer Metal |
|---|---|---|---|---|
| AA4343 | 10 | AA3003 | 1 | Copper |
| AA4343 | 10 | AA3003 | 1 | AA1100 |
| AA4343 | 10 | AA3003 | 1 | AA7072 |
| AA4343 | 10 | AA3003 | 1 | AA1070 |

The invention claimed is:

1. A method of producing a clad metal ingot suitable for rolling to form a clad metal sheet, which method comprises the steps of:

providing a solid core ingot having an upper rolling face and at least two undercut cavities extending inwardly into the ingot from said upper rolling face at mutually spaced positions;

blocking all, or all-but-one, of said at least two cavities against molten metal entry to form one or more blocked cavities, and providing a casting core extending outwardly from said rolling face in alignment with each of said one or more blocked cavities, the or each casting core having a shape effective to produce an undercut void in a subsequently cast cladding layer;

casting a molten metal on said upper rolling face around said casting core(s) to produce a composite ingot having a solid cladding layer cast on said upper rolling face of said core ingot, except where covered by said casting core(s);

removing said casting core(s) to form one or more undercut voids in said cladding layer and unblocking said blocked cavity(ies), thereby interconnecting aligned void(s) and cavity(ies); and filling said aligned void(s) and cavity(ies) with a molten metal and allowing said metal to solidify to form at least one metal lug therein attaching said cladding layer to said core ingot.

2. The method of claim 1, wherein, after casting said molten metal on said upper rolling face and allowing said metal to cool to form said cladding layer, but before removing said casting core(s), further molten metal is cast on said cladding layer to form a second cladding layer on said core ingot.

3. The method of claim 2, wherein said further molten metal is chosen to be the same as the molten metal used to form the first cast cladding layer.

4. The method of claim 2, wherein said further molten metal is chosen to be different from the molten metal used to form the first cast cladding layer.

5. The method of claim 1, wherein, after removing said casting core(s) and unblocking said at least one cavity, but before filling said aligned void(s) and cavity(ies) with a molten metal, said cladding layer is separated from said upper rolling face and at least one solid layer of metal is introduced between said rolling face and said cladding layer, said at least one solid layer having a hole or holes aligned with said cavity(ies) and said void(s).

6. The method of claim 1, wherein said casting core(s) has (have) an inner end shaped and dimensioned to fit securely within an entrance of said at least one cavity, and said casting core(s) is (are) positioned with said inner end positioned in said entrance to effect said blocking of said at least one cavity against metal entry.

7. The method of claim 1, wherein each of said at least two cavities is formed as an elongated channel having a dovetail cross-sectional shape.

8. The method of claim 1, wherein said casting form(s) is (are) shaped as an elongated member having a dovetail cross-sectional shape.

9. The method of claim 1, wherein said core metal ingot has an intended rolling direction and is provided with at least one cavity in said upper rolling face adjacent to a head end of said ingot and at least one cavity adjacent to a tail end of said ingot.

10. The method of claim 1, wherein said core metal ingot has an intended rolling direction and is provided with a transversely extending elongated cavity in said upper rolling face adjacent to a head end of said ingot, and a pair of longitudinally extending elongated cavities adjacent to a tail end of said ingot, with each member of said pair being positioned adjacent to an opposite lateral side edge of said rolling face.

11. The method of claim 10, wherein said transversely extending elongated cavity is caused to extend completely from one side edge to an opposite side edge of said rolling face, and wherein each of said longitudinally extending cavities is caused to extend for a limited distance from said tail end of said ingot towards said head end.

12. The method of claim 1, wherein a metal flux compound is applied to the upper rolling face prior to said casting of said molten metal on said face.

13. The method of claim 12, wherein said metal flux compound is applied as a solid layer.

14. The method of claim 1, wherein said core ingot has a lower rolling face and, after forming said lug(s), said ingot is inverted and said steps of the method repeated to form a cladding layer attached to said lower rolling face of said core ingot.

15. A process of producing a clad metal sheet, which comprises producing a clad ingot by the method of claim 1, followed by rolling the clad ingot to form a sheet.

16. A clad metal ingot suitable for rolling to form a clad metal sheet, comprising:

a core metal ingot having at least one rolling face;

at least one cast-in-place cladding layer overlying said at least one rolling face; and at least one cast-in-place metal lug attaching together said core metal ingot and said at least one cladding layer, said at least one lug having been cast-in-place separately from and subsequently to said at least one cladding layer within a cavity extending from an outer surface of said clad metal ingot, through said at least one cladding layer and into core metal ingot.

17. A clad rolled metal sheet having a core layer and at least one cladding layer, said sheet having been formed by rolling the clad metal ingot of claim 16.

18. A clad metal ingot suitable for rolling to form a clad metal sheet, comprising:

a core metal ingot having an intended rolling direction, a head end intended to pass first through a rolling mill, a tail end opposite the head end, and at least one rolling face;

at least one cast-in-place cladding layer overlying said at least one rolling face; and at least two cast-in-place metal lugs attaching together said core metal ingot and said at least one cladding layer, one of said at least two lugs being positioned adjacent to said head end of said core metal ingot and at least one other of said lugs being positioned adjacent to said tail end, at least one of said lugs having been cast-in-place separately from and subsequently to said at least one cladding layer within a cavity extending from an outer surface of said clad metal ingot, through said at least one cladding layer and into said core metal ingot.

19. The clad metal ingot of claim 18, wherein said one lug positioned adjacent to said head end of said core metal ingot is made of a metal that is continuous with metal of said at least one cast-in-place cladding layer, being a cast-in-place metal lug formed at the same time as said at least one cast-in-place cladding layer.

20. The clad metal ingot of claim 19, wherein said at least one other lug positioned adjacent to said tail end of the core metal ingot is made of metal that is discontinuous with metal of said at least one cast-in-place cladding layer, being a lug cast-in-place separately from and subsequently to said at least one cladding layer within a cavity extending from an outer surface of said clad metal ingot, through said at least one cladding layer and into said core metal ingot.

21. The clad metal ingot of claim 18, wherein said one lug positioned adjacent to said head end of said core metal ingot has a length at said rolling face longer than a width thereof, said lug being orientated with its length extending transversely to said rolling direction.

22. The clad metal ingot of claim 21, having at least two of said other lugs positioned adjacent to said tail end of said core metal ingot, each of said other lugs having a length at said rolling face greater than a width thereof, said other lugs being oriented with said lengths thereof extending in said rolling direction.

23. The clad metal ingot of claim 22, having two of said other lugs, each one positioned adjacent to an opposite side of said core metal ingot adjacent to said tail end thereof.

* * * * *